US007568442B2

(12) United States Patent
Kruppa

(10) Patent No.: US 7,568,442 B2
(45) Date of Patent: Aug. 4, 2009

(54) THREE DEGREE-OF-FREEDOM PIVOT ASSEMBLY, SAIL-MOUNTED BALLAST, AND SAIL CONTROL SYSTEM FOR HIGH SPEED SAILBOATS

(76) Inventor: Alan William Kruppa, 7826 E. Radhost School Rd., La Grange, TX (US) 78945

( * ) Notice: Subject to any disclaimer, the term of this patent is extended or adjusted under 35 U.S.C. 154(b) by 0 days.

(21) Appl. No.: 11/733,031

(22) Filed: Apr. 9, 2007

(65) Prior Publication Data

US 2008/0245284 A1 Oct. 9, 2008

(51) Int. Cl.
*B63H 9/04* (2006.01)

(52) U.S. Cl. ..... 114/102.1; 114/39.11; 114/39.21

(58) Field of Classification Search ..... 114/102.1, 114/102.11, 102.12, 102.14, 102.15, 102.18, 114/104, 105, 106, 107, 39.31, 39.11, 39.14, 114/39.21, 39.24, 39.25, 39.26, 39.27, 91
See application file for complete search history.

(56) References Cited

U.S. PATENT DOCUMENTS

| | | | | |
|---|---|---|---|---|
| 3,332,384 | A * | 7/1967 | Potter | 114/106 |
| 3,802,366 | A * | 4/1974 | Mankawich | 114/39.31 |
| 4,437,426 | A * | 3/1984 | Latham | 114/102.18 |
| 4,685,410 | A * | 8/1987 | Fuller | 114/39.31 |
| 4,843,987 | A * | 7/1989 | Samuels | 114/39.31 |
| 5,060,590 | A * | 10/1991 | Springall | 114/91 |
| 5,063,869 | A * | 11/1991 | Bielefeldt | 114/39.31 |

* cited by examiner

*Primary Examiner*—Lars A Olson

(57) ABSTRACT

A sailboat is disclosed wherein the sailboat includes a three degree-of-freedom pivot assembly, sail-mounted ballast, and sail control system. These three features increase sailing efficiency and reduce both hydrodynamic and aerodynamic drag on the sailboat. This sailboat incorporates a rigid sail with sail-mounted ballast to balance the rolling moment and pitching moment produced on the sail by the wind. The rigid self-supported sail increases sailing efficiency by eliminating the need for supporting wires and structures and by taking advantage of the superior aerodynamic characteristics of rigid sails over flexible sails. Finally, the sail control system controls the sail's orientation by rotating the components of the three degree-of-freedom pivot assembly to maximize the sail's aerodynamic efficiency.

16 Claims, 8 Drawing Sheets

THREE DEGREE-OF-FREEDOM PIVOT ASSEMBLY, SAIL-MOUNTED BALLAST, AND SAIL CONTROL SYSTEM FOR HIGH SPEED SAILBOATS

REFERENCES CITED

U.S. PATENT DOCUMENTS

| | | | |
|---|---|---|---|
| 4,286,533 | September 1981 | Sanner | 114/124 |
| 4,653,417 | March 1987 | White | 114/91 |
| 4,674,427 | June 1987 | Finot | 114/39 |
| 4,917,036 | April 1990 | Berg | 114/91 |
| 4,945,845 | August 1990 | Johnson | 114/39.1 |
| 5,060,590 | October 1991 | Springall | 114/91 |
| 5,509,368 | April 1996 | Wald | 114/39.1 |
| 5,529,007 | June 1996 | Fitzpatrick | 114/91 |
| 5,560,310 | October 1996 | Christensen | 114/91 |
| 5,884,575 | March 1999 | Talasimov | 114/124 |
| 5,918,561 | July 1999 | Berean | 114/102.16 |
| 6,058,867 | May 2000 | Ettel | 114/91 |
| 6,105,524 | August 2000 | Dane | 114/39.21 |
| 6,341,571 | January 2002 | Russell | 114/39.21 |
| 6,691,632 | February 2004 | Stevens | 114/39.31 |
| 6,779,473 | August 2004 | Maconochie | 114/39.13 |
| 6,789,489 | September 2004 | Phipps | 114/91 |

BACKGROUND OF THE INVENTION

This invention is a high speed sailboat design incorporating features that improve sailing efficiency and minimize aerodynamic drag. The initial goal of this invention is to break the world sailing speed record for distance traveled over 24 hours and speed over a 500 meter course. At the time of this application, the current 24 hour distance record is 766.8 nautical miles (an average speed of 31.95 knots) set in 2006 by Orange II, a 120 foot long catamaran. The outright speed record on a 500 meter course is 48.70 knots set in 2005 by a windsurfer. For a boat, the outright speed record on a 500 meter course is 46.52 knots set in 1993 by Yellow Pages Endeavor, a one tack design with a self-supported rigid sail.

Like Orange II, this invention will likely use a catamaran design because it provides inherent lateral stability while eliminating the need for ballast below the waterline, therefore eliminating a significant source of hydrodynamic drag. Like Yellow Pages Endeavor, this invention will use a self-supported rigid sail, which provides superior aerodynamic efficiency compared to traditional flexible sails while eliminating standing rigging, therefore eliminating a significant source of aerodynamic drag. And like a windsurfer shifting his or her weight to balance the rolling moment produced on the sail, this invention will use sail-mounted ballast above the waterline to balance the rolling moment produced on the sail by the wind. But unlike a windsurfer, the human operator will not be exposed to the air and will therefore not add to the aerodynamic drag experienced by the sailboat.

In short, this invention is a catamaran sailboat design that uses a three degree-of-freedom pivot assembly to position the sail for optimum aerodynamic efficiency, which in turn positions the sail-mounted ballast to provide an anti-heeling capability.

Prior craft to which this invention can be usefully compared and contrasted are listed below. The ability to tilt the sail to windward has been previously suggested in U.S. Pat. Nos. 4,917,036; 5,509,368; and 6,058,867, but these devices are limited to tilting athwartships. The ability to pivot the sail about 2 or 3 degrees-of-freedom has been previously suggested in U.S. Pat. Nos. 4,653,417; 4,945,845; 5,060,950; 5,918,561; 6,105,524; 6,341,571; 6,779,473; and 6,789,489, but none of these devices control the sail's orientation in the same way as the present invention. The use of rigid sails and aerodynamic control surfaces has been previously suggested in U.S. Pat. Nos. 4,674,427; 6,341,571; and 6,691,632, but none of these previous inventions are similar in function to the present invention because they are all intended to fly for brief periods of time. The idea of movable ballast above the waterline has been previously suggested in U.S. Pat. Nos. 4,286,533; 5,529,007; 5,560,310; and 5,884,575, but none have ballast mounted to the sail in the same way as the present invention.

The devices in U.S. Pat. Nos. 5,918,561 and 6,341,571 have noteworthy similarities to the present invention. The sailboat in U.S. Pat. No. 5,918,561 has the ability to orient the sail for optimum efficiency about three degrees-of-freedom but does not use a single pivot assembly to control the movement of the sail. Nor does it have the capability to control movement of the sail about similar axes to the pivot assembly in the present invention. U.S. Pat. No. 6,341,571 incorporates a similar three degree-of-freedom pivot assembly with rotation about similar axes to the pivot assembly described herein, but the control mechanisms and purposes for the two pivot assemblies are different. Specifically, the pivot assembly in U.S. Pat. No. 6,341,571 is used to control the orientation of a pair of canted wing-sails whereas the pivot assembly in this invention is used to control the orientation of a single self-supported sail. Nor does the pivot assembly in U.S. Pat. No. 6,341,571 maintain the hull in a level attitude as does the pivot assembly in the present invention. Finally, the wind-powered watercraft in U.S. Pat. No. 6,341,571 is capable of flying for brief periods of time due to its inherent ability to produce a significant about of vertical lift on its pair of canted wings. The present invention does not have this flight capability because it is intended to produce much more lateral lift than the device in U.S. Pat. No. 6,341,571 and only a minimal amount of vertical lift.

BRIEF SUMMARY OF THE INVENTION

This sailboat design is different from conventional sailboat designs in the way it produces propulsion and maintains balance. For propulsion, instead of flexible sails attached to a rigid mast, this sailboat uses a rigid sail with a symmetric airfoil cross section, mounted to a three degree-of-freedom pivot assembly attached to the hull. And for ballast, instead of weight below the waterline in a fixed keel, this invention uses a fixed or movable weight mounted inside or outside of the sail.

Using sail-mounted ballast reduces hydrodynamic drag by reducing structure below the waterline. To balance the heeling moment produced by the sail this sailboat uses its sail control system to tilt the sail to the side opposite the direction of the lateral force on the sail. The sail-mounted ballast thus produces a heeling moment opposite to that produced by the wind on the sail. Because the ballast is mounted to the sail, the sailboat is not naturally stable. In other words, the sail will fall over if it is not kept up. The sail control system keeps the sail up by using mechanical devices and by adjusting the force produced on the sail by the wind. The catamaran hull provides additional lateral stability.

The use of a rigid sail instead of a conventional flexible sail increases the efficiency of this sailboat by reducing aerodynamic drag. The conventional standing rigging used to support flexible sails has exposed lines and exposed bodies which are not streamlined and which do not produce lift and, therefore, serve only to increase drag and decrease the sailing efficiency of the sailboat.

The ability to move the rigid sail in three degrees of freedom enables the sail to maintain an orientation that maximizes the sail's lift-to-drag ratio for a given relative wind condition. The sail control system aligns the leading edge of the sail approximately perpendicular to the relative wind direction, the orientation that maximizes the lift-to-drag ratio of the sail. The lift-to-drag ratio, or L/D, is a measure of lifting efficiency, so the ability to align the sail's leading edge perpendicular to the relative wind direction increases the sailing efficiency of this sailboat.

When conventional sailboats heel away from the wind, they are pushed down into the water by the force on the sail, increasing hydrodynamic drag. Because this sailboat has a sail that tilts opposite the direction of the lateral force on the sail, the sailboat is lifted up by the force on the sail. This lifting effect partially lifts the sailboat hull out of the water, further reducing hydrodynamic drag.

DETAILED DESCRIPTION OF THE INVENTION

Figure 1:
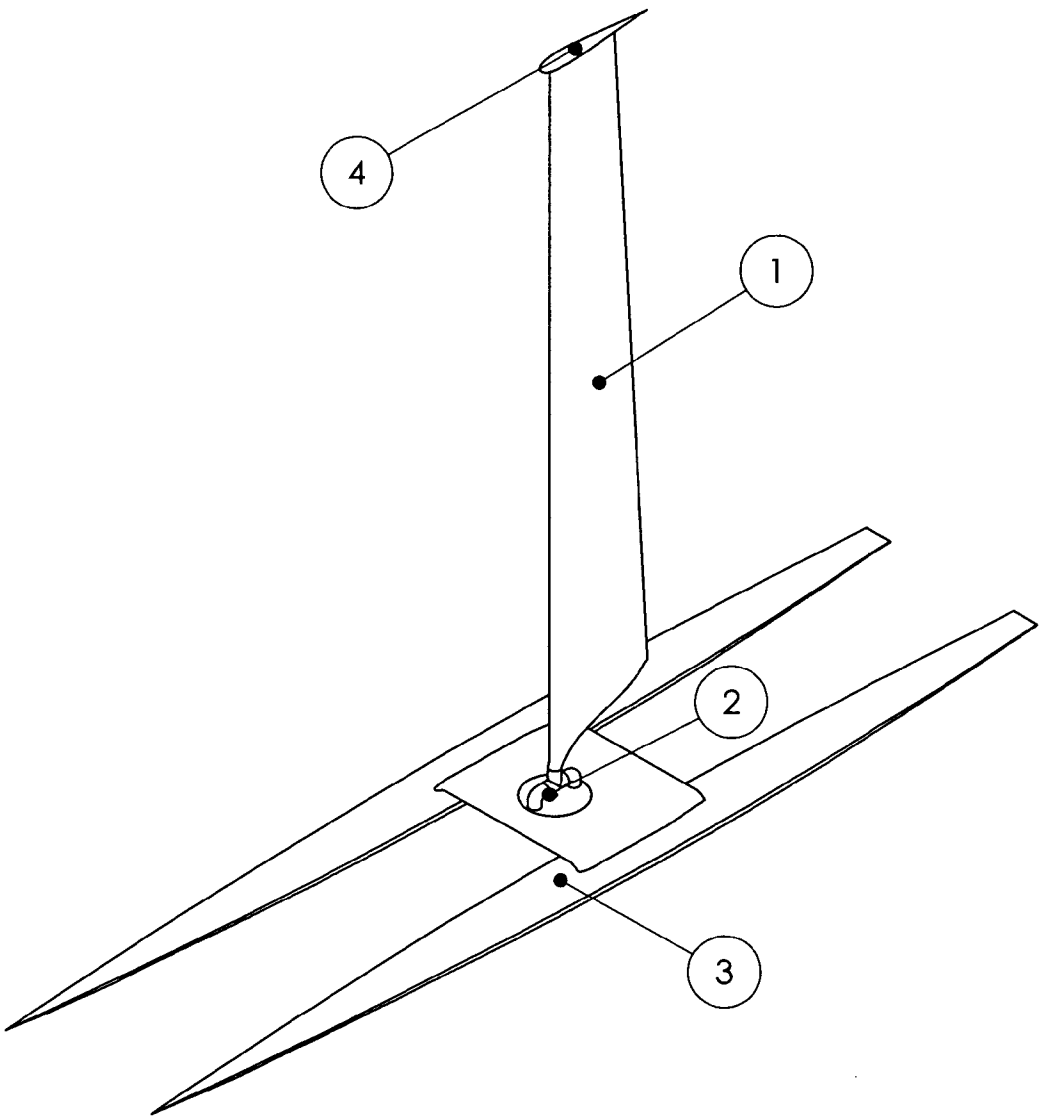
FIG. 1: Isometric view of sailboat

FIG. 1 is an isometric view of a representative sailboat configuration. The sail 1 has a symmetric airfoil cross section and is mounted on one end to the three degree-of-freedom pivot assembly 2, which is mounted to the catamaran hull 3. In this figure, the ballast 4 is the fixed teardrop shaped structure mounted on the free tip of the wing.

Figure 2:
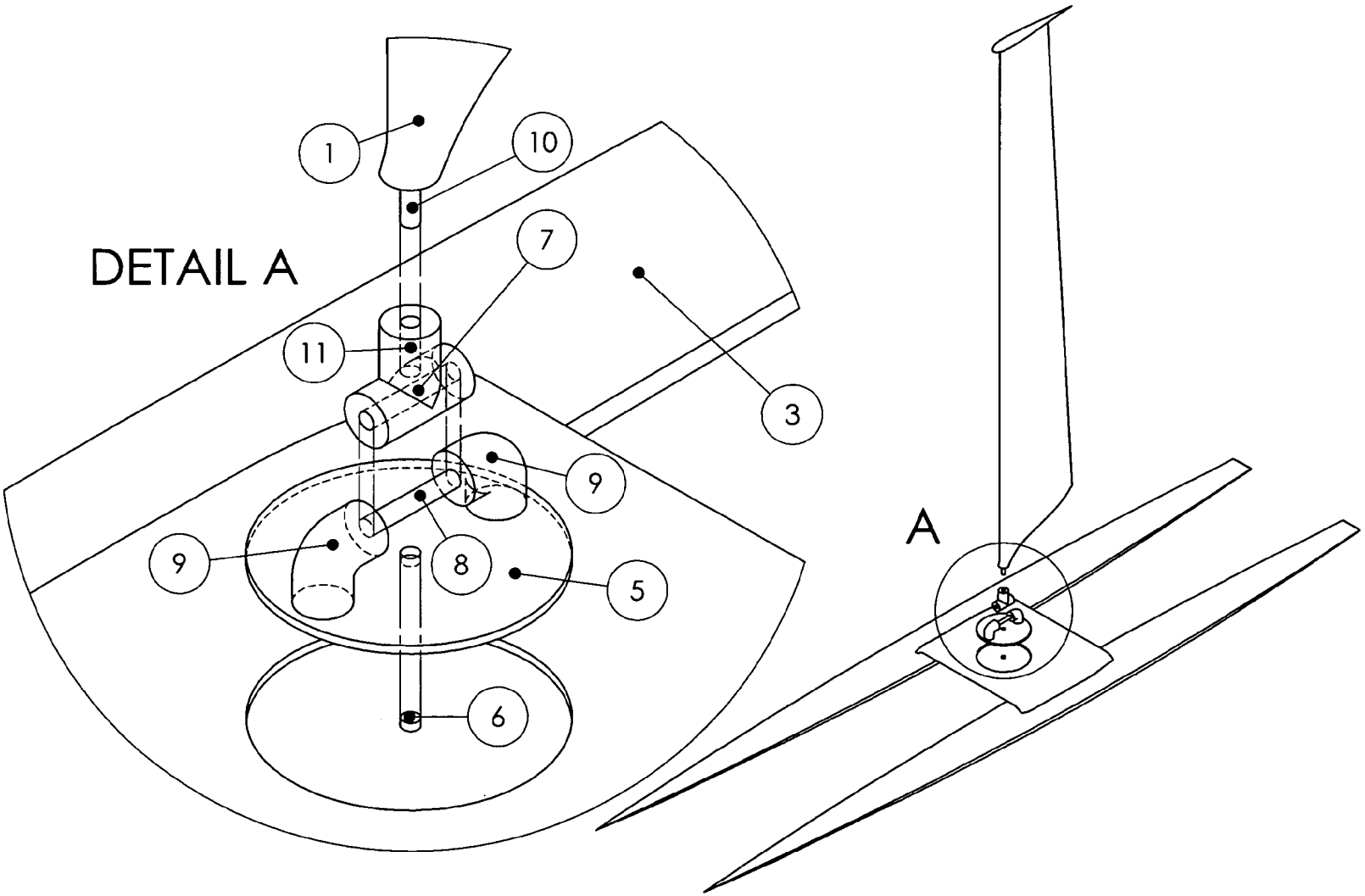
FIG. 2: Expanded pivot assembly detail

FIG. 2 includes an isometric view of the sailboat to show the position of Detail A, which shows an expanded view of a representative pivot assembly. This expanded view is used here to show how the pivot assembly components fit together and rotate about one another. The vertical pivot 5 slides down over and rotates about the center tube 6 on the catamaran hull 3. The relative wind pivot 7 fits over and rotates about the tube 8 that connects the fore and aft structures 9 on the vertical pivot. The tube 10 extending from the bottom of the sail 1 fits into and rotates within the top hole 11 of the relative wind pivot.

Figure 3:
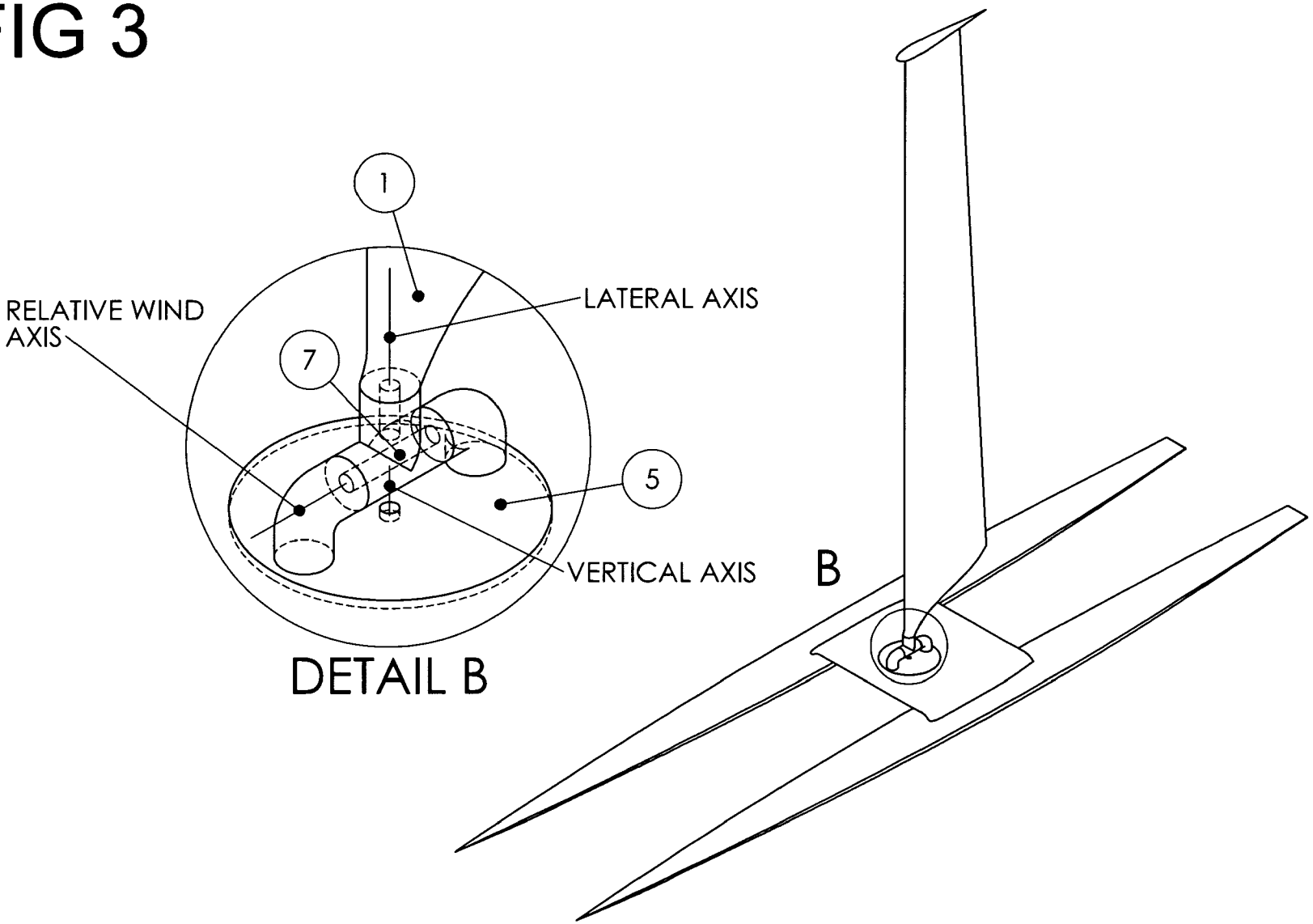
FIG. 3: Pivot assembly detail with rotational axes

FIG. 3 includes an isometric view of the sailboat to show the position of Detail B, which shows the operational characteristics of the representative three degree-of-freedom pivot assembly. The vertical pivot 5 is pivotally mounted to the catamaran hull and rotates about the vertical axis. The vertical axis gets its name from its vertical orientation. The relative wind pivot 7 is pivotally mounted to the vertical pivot and rotates about the relative wind axis. The relative wind axis gets its name because when the leading edge of the wing is aligned approximately perpendicular to the relative wind direction, the ideal orientation for maximum efficiency, the relative wind axis is approximately aligned with the relative wind direction. The sail 1 is pivotally mounted to the relative wind pivot and rotates about the lateral axis. The lateral axis gets its name because it runs laterally along the sail.

The sail control system, which is not shown in any of the figures, controls the orientation of the sail by controlling the angle of rotation of each element of the pivot assembly. That is to say, it controls the angle of rotation of the vertical pivot about the vertical axis, the angle of rotation of the relative wind pivot about the relative wind axis, and the angle of rotation of the sail about the lateral axis.

The sail control system adjusts the angle of rotation of the vertical pivot about the vertical axis in order to align the relative wind axis with the relative wind direction. It adjusts the angle of rotation of the relative wind pivot about the relative wind axis in order to tilt the sail-mounted ballast to the side opposite the direction of the lateral force produced on the sail, producing a heeling moment to balance the heeling moment produced on the sail by the wind. It adjusts the angle of rotation of the sail to control the sail's angle of attack, which controls the amount of force produced on the sail by the wind.

The sail control system could take many forms. It could use rigid linkages, hydraulics, clutches, or some other mechanical means or combination thereof to adjust and control the angles of rotation of the pivot assembly pivots. It could also use an aerodynamic control surface(s) placed in front or, behind, or on the sail itself in order to adjust the angle of attack of the sail, which corresponds to an adjustment of the angle of rotation of the sail about the lateral axis. This control surface(s) could also be used in concert with other mechanical means within the pivot assembly to control the orientation of the other pivot assembly pivots. For example, to tilt the sail from a trimmed condition—a trimmed condition exists when the pivot assembly is mechanically locked about the vertical and relative wind axes, when the sail's leading edge is oriented approximately perpendicular to the relative wind, and when the sail is tilted to balance the heeling moment produced on the sail by the wind—the sail's angle of attack could be changed in order to produce a moment that will tilt the sail in either direction. In order to tilt the sail to a new position, the mechanical lock about the relative wind axis would have to be released to allow movement and then reengaged to lock the sail in the new position. So in this case, the angle of attack of the sail was adjusted and used in concert with the mechanical lock about the relative wind axis in order to adjust the angle of rotation, or tilt, of the sail about the relative wind axis.

Figure 4:
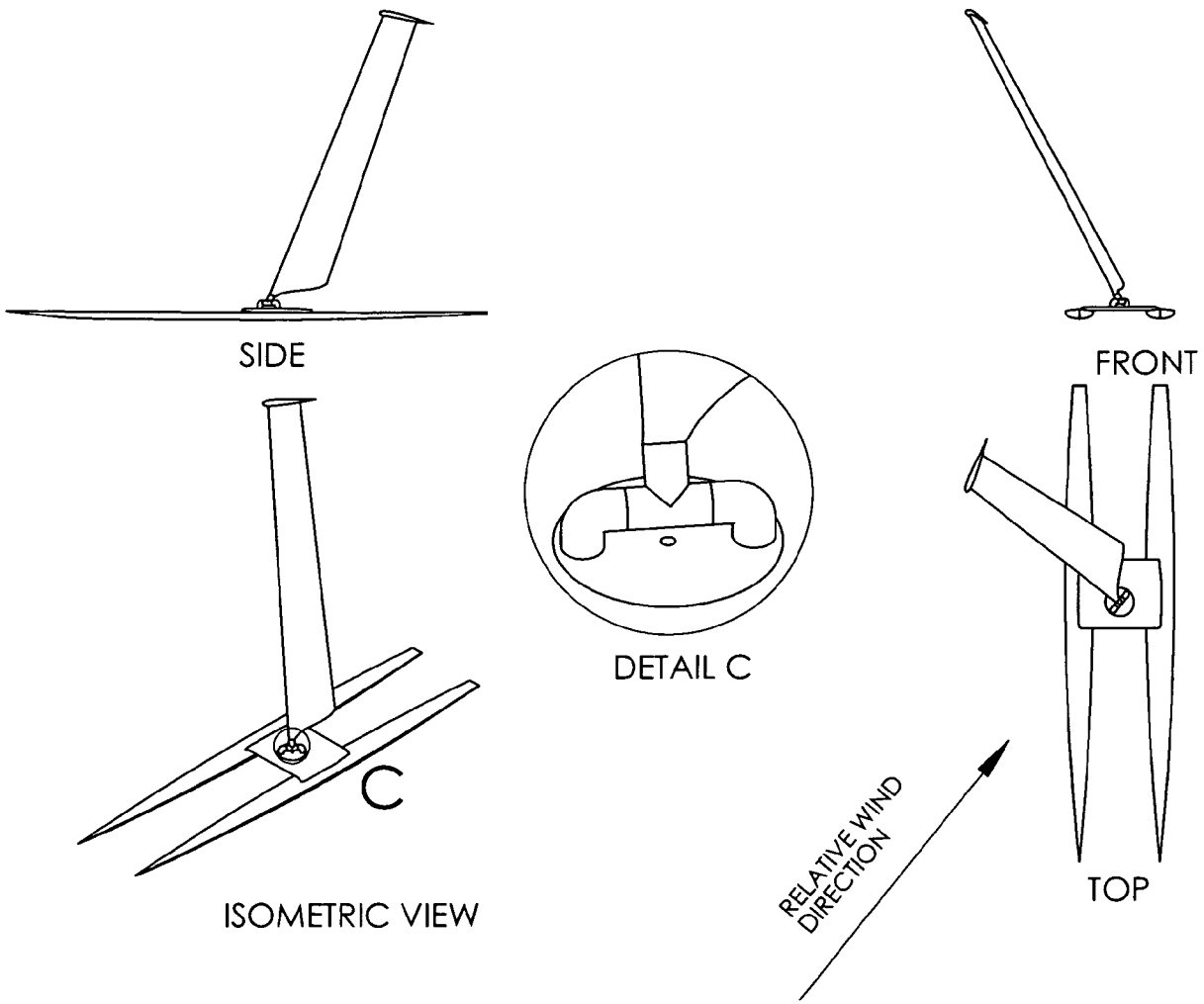
FIG. 4: Four views of sailboat on a starboard close reach with pivot assembly detail
Figure 5:
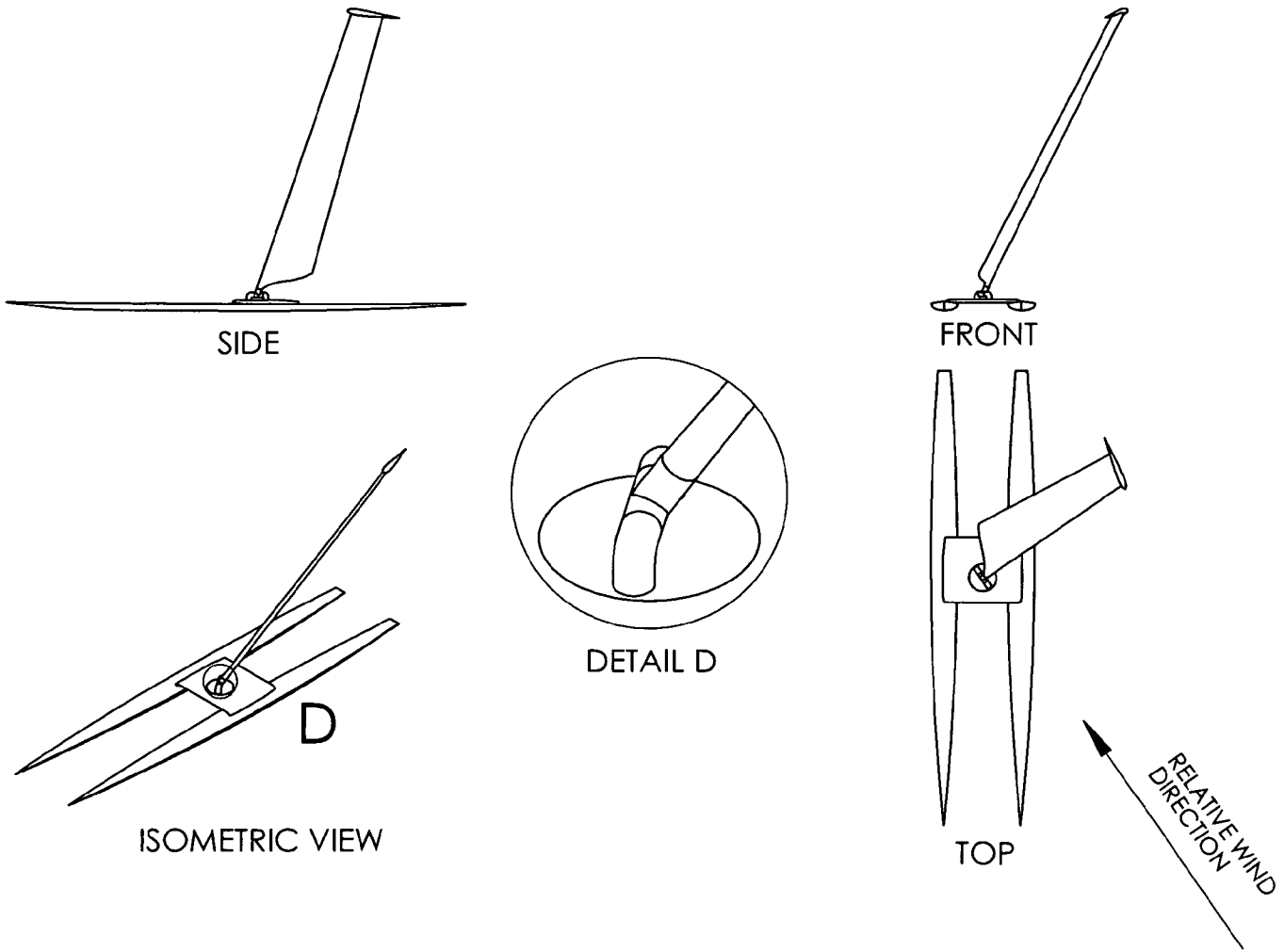
FIG. 5: Four views of sailboat on a port close reach with pivot assembly detail
Figure 6:
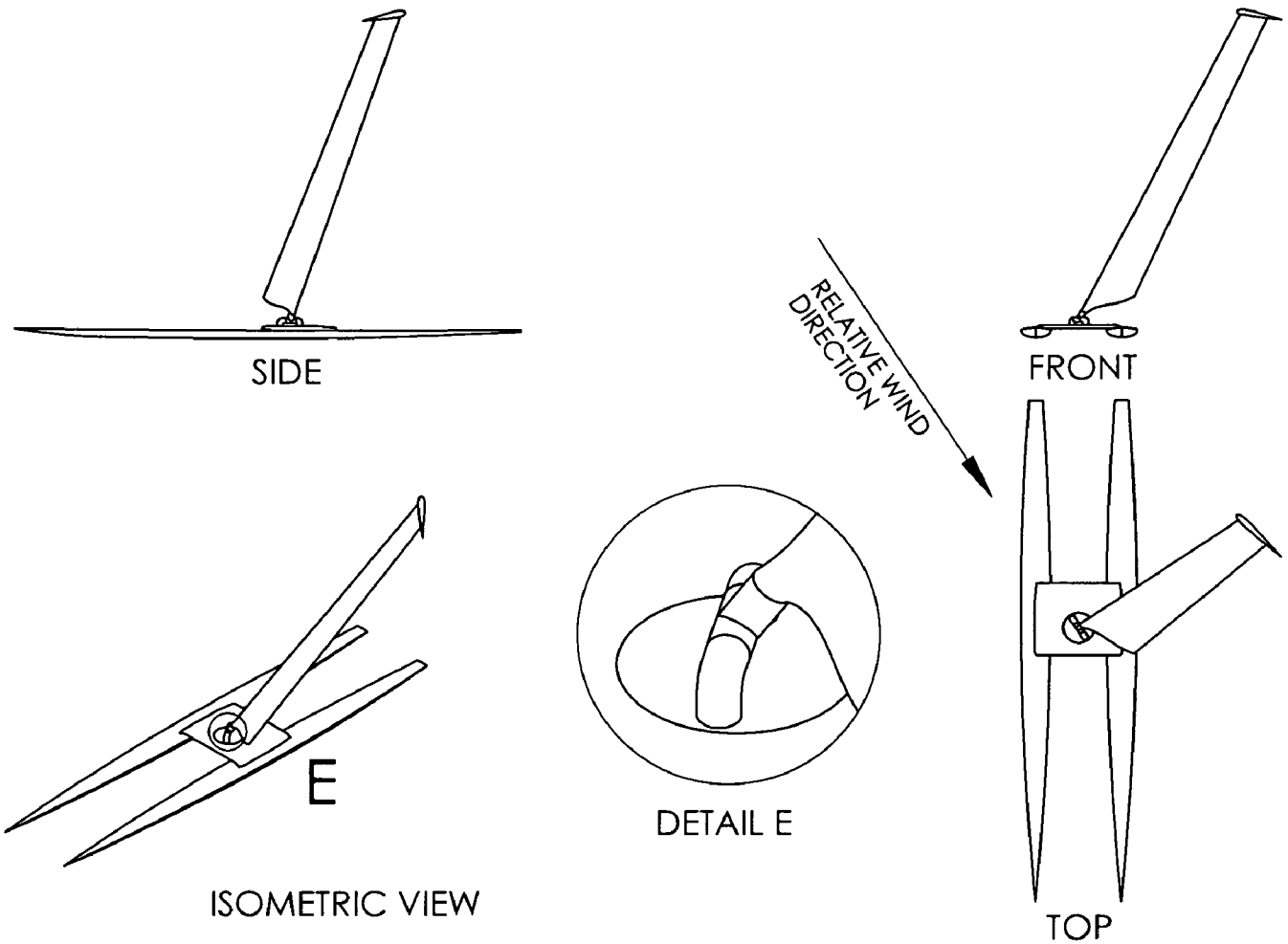
FIG. 6: Four views of sailboat on a starboard broad reach with pivot assembly detail
Figure 7:
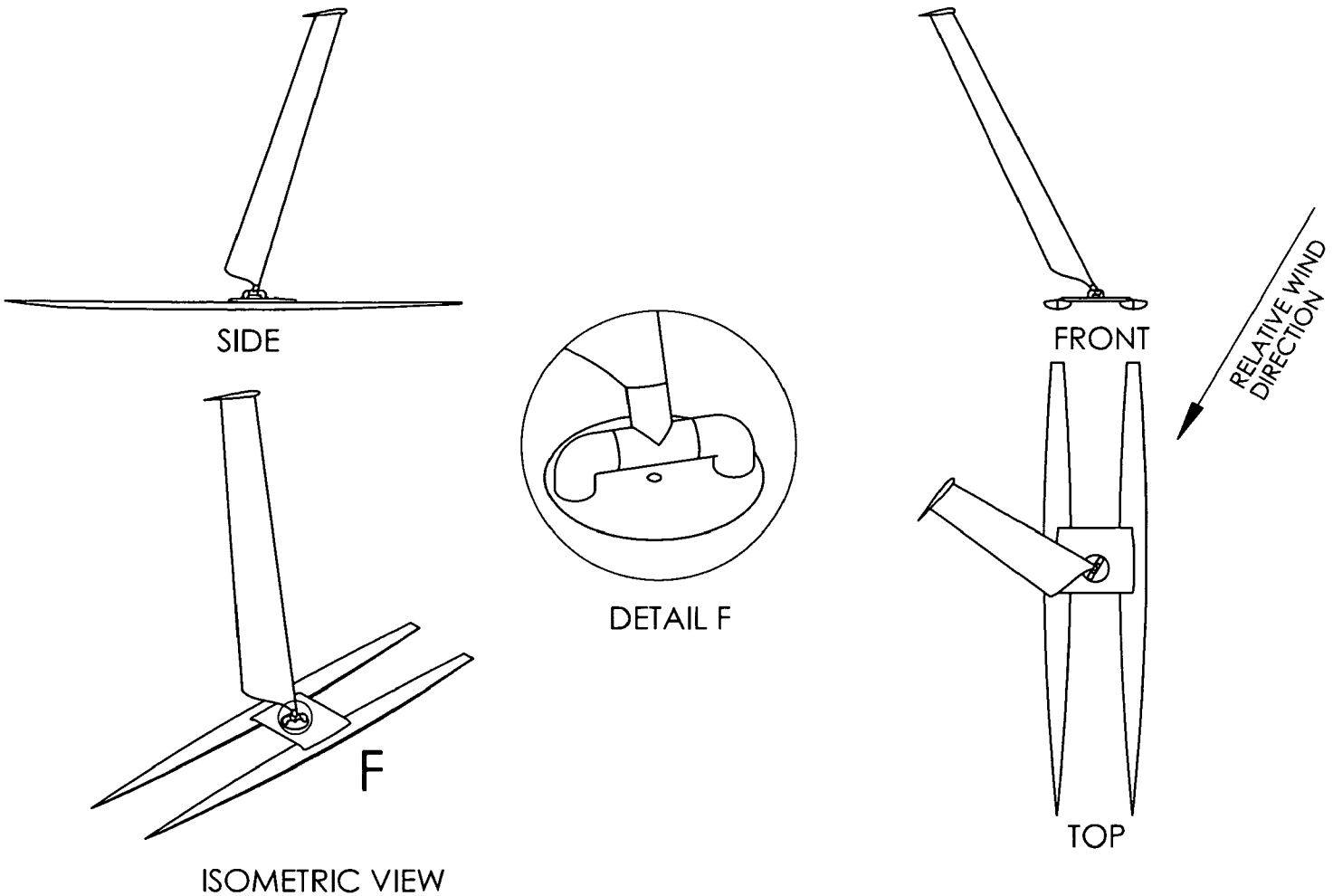
FIG. 7: Four views of sailboat on a port broad reach with pivot assembly detail

FIGS. 4 through 7 each include four views of the sailboat (side, front, isometric, and top) and a detail of the representative pivot assembly from the respective isometric view. These four figures show the sail position on four different points of sail, that is to say, under four different relative wind conditions. In FIG. 4, the sailboat is on a starboard close reach, that is to say, the relative wind is coming from the forward starboard region of the boat, as indicated by the arrow. In FIG. 5, the sailboat is on a port close reach, that is to say, the relative wind is coming from the forward port region of the boat, as indicated by the arrow. In FIG. 6, the sailboat is on a starboard broad reach, that is to say, the relative wind is coming from the aft starboard region of the boat, as indicated by the arrow. In FIG. 7, the sailboat is on a port broad reach, that is to say, the relative wind is coming from the aft port region of the boat, as indicated by the arrow. These figures serve to illustrate the ability to orient the sail according to typical wind conditions.

Figure 8:
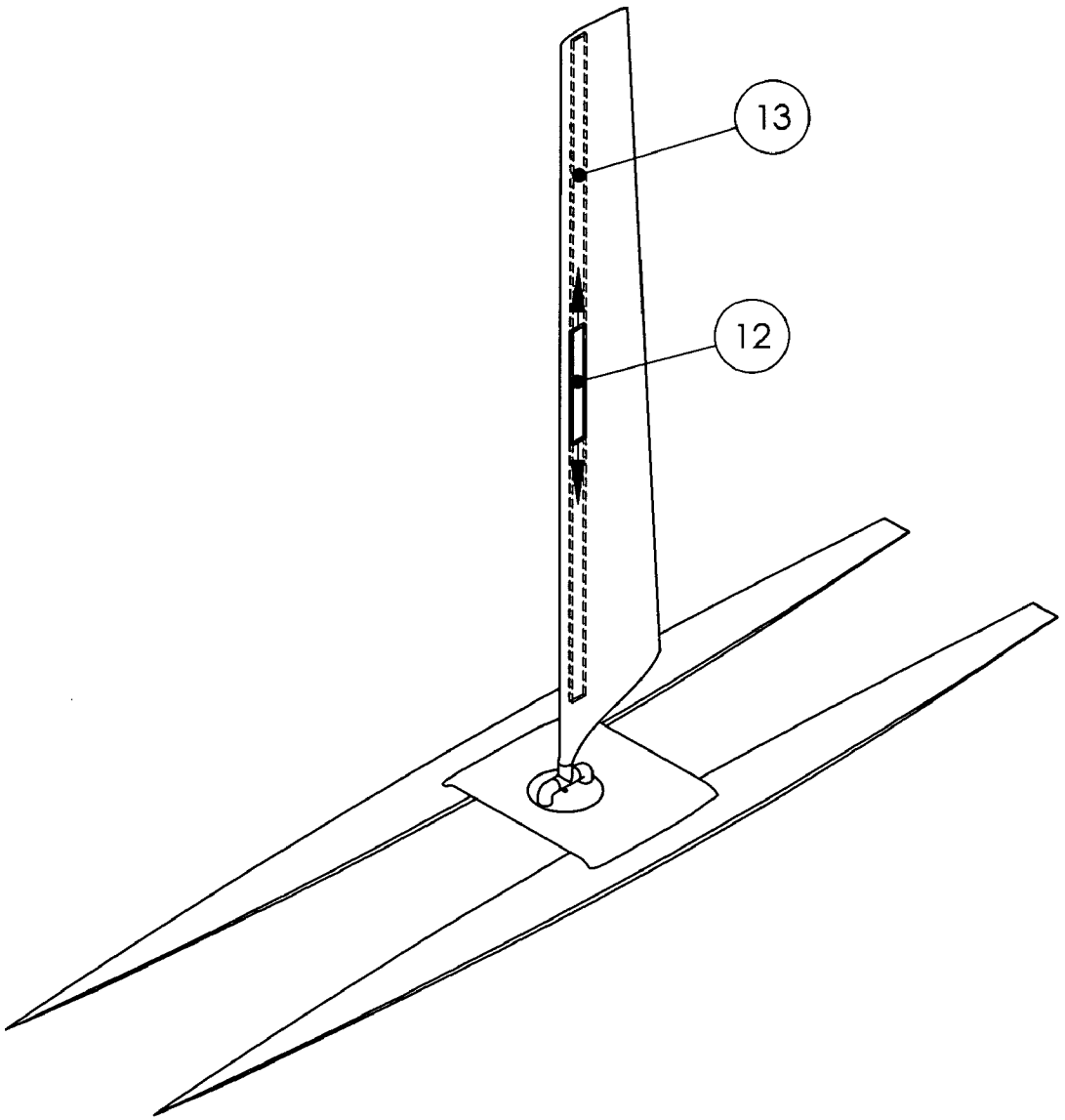
FIG. 8: Isometric view of sailboat with movable ballast

FIG. 8 depicts a possible movable ballast configuration, illustrating how a movable weight 12 can be placed inside the sail on a track 13 and adjusted to a desired height by ropes and pulleys, hydraulics, or any other mechanical means. The arrows serve to illustrate the ability to move the ballast up or down within the track. The movable ballast could also be placed outside the sail if so desired.

The invention claimed is:

1. A system for utilizing wind forces to provide motion comprising:

a hull adapted to move across a surface in a first direction;

a pivot assembly rotatably mounted to the hull and adapted to rotate about a vertical axis approximately orthogonal to the surface;

a sail rotatably mounted to the pivot assembly;

the pivot assembly adapted to limit the sail to two degrees of freedom;

wherein a first degree of freedom of the two degrees of freedom is adapted to enable the sail to pivot around a relative-wind axis approximately orthogonal to the vertical axis, the relative-wind axis being oriented in a direction defined by the rotation of the pivot assembly about the vertical axis;

wherein a second degree of freedom of the two degrees of freedom is adapted to enable rotation of the sail about a mast axis approximately orthogonal to the relative-wind axis;

a ballast coupled to the sail; and wherein the ballast creates a ballast moment force when the sail pivots away from the vertical axis around the relative-wind axis.

2. The system of claim 1, wherein the hull is a catamaran hull.

3. The system of claim 1, wherein the sail is a rigid sail.

4. The system of claim 1, wherein the ballast is slidably mounted to the sail.

5. The system of claim 1, wherein the ballast moment force at least partially counterbalances wind moment forces caused by wind forces pushing against the sail.

6. The system of claim 1, wherein orientation of the sail relative to the hull is controlled manually.

7. The system of claim 1, wherein orientation of the sail relative to the hull is controlled automatically.

8. The system of claim 1, wherein the ballast moment force is increased by sliding the ballast away from the hull.

9. A method for utilizing wind forces to provide motion comprising:

providing a hull adapted to move across a surface in a first direction;

rotatably mounting a pivot assembly to the hull, the pivot assembly being adapted to rotate about a vertical axis approximately orthogonal to the surface;

rotatably mounting a sail to the pivot assembly so that movement of the sail is limited to two degrees of freedom;

wherein a first degree of freedom of the two degrees of freedom is adapted to allow the sail to pivot along a relative-wind axis approximately orthogonal to the vertical axis, the relative-wind axis being oriented in a direction defined by the rotation of the pivot assembly about the vertical axis;

wherein a second degree of freedom of the two degrees of freedom is adapted to allow rotation of the sail about a mast axis approximately orthogonal to the relative-wind axis;

coupling a ballast to the sail to provide a counter balance; and wherein the ballast is slidably mounted to the sail.

10. The method of claim 9, wherein the hull is a catamaran hull.

11. The method of claim 9, wherein the sail is a rigid sail.

12. The method of claim 9 and further comprising:

pivoting the sail around the relative-wind axis and away from the vertical axis to create a ballast moment force to at least partially counterbalance wind forces pushing against the sail.

13. The method of claim 12 and further comprising:

sliding the ballast away from the hull to increase the ballast moment force.

14. The method of claim 9 and further comprising:

orienting the sail relative to the hull utilizing manually operated controls.

15. The method of claim 9 and further comprising:

orienting the sail relative to the hull utilizing an automated control system.

16. A system for utilizing wind forces to provide motion comprising:

a hull adapted to move across a surface in a first direction;

a pivot assembly rotatably mounted to the hull and adapted to rotate about a vertical axis approximately orthogonal to the surface;

a sail rotatably mounted to the pivot assembly;

the pivot assembly adapted to limit the sail to two degrees of freedom;

wherein a first degree of freedom of the two degrees of freedom is adapted to enable the sail to pivot around a relative-wind axis approximately orthogonal to the vertical axis, the relative-wind axis being oriented in a direction defined by the rotation of the pivot assembly about the vertical axis;

wherein a second degree of freedom of the two degrees of freedom is adapted to enable rotation of the sail about a mast axis approximately orthogonal to the relative-wind axis;

a ballast coupled to the sail; and wherein the ballast is slidably mounted to the sail.

* * * * *